United States Patent [19]

Whiteley

[11] 4,054,764

[45] Oct. 18, 1977

[54] SPEED RESPONSIVE SWITCHING DEVICE

[75] Inventor: Eric Whiteley, Peterborough, Canada

[73] Assignee: General Electric Company, Schenectady, N.Y.

[21] Appl. No.: 686,912

[22] Filed: May 17, 1976

[30] Foreign Application Priority Data

June 5, 1975 Canada ..... 228772

[51] Int. Cl.[2] ..... H01H 35/00

[52] U.S. Cl. ..... 200/61.46; 200/61.39; 310/68 R

[58] Field of Search ..... 200/61.39, 61.46; 73/517 R, 517 A, 517 B; 318/465, 489; 310/68 R, 68 B, 68 E; 335/219, 236

[56] References Cited

U.S. PATENT DOCUMENTS

| | | | |
|---|---|---|---|
| 2,718,567 | 9/1955 | Elliot et al. | 200/61.39 X |
| 2,816,187 | 12/1957 | Smith | 200/61.39 |
| 3,012,157 | 12/1961 | Baring et al. | 200/61.46 X |
| 3,021,402 | 2/1962 | La Warre et al. | 200/61.46 |
| 3,025,369 | 3/1962 | Wargo | 200/61.46 |
| 3,527,905 | 9/1970 | Doi | 200/61.39 X |

*Primary Examiner*—James R. Scott
*Attorney, Agent, or Firm*—Vale P. Myles

[57] ABSTRACT

An overspeed switching mechanism for a motor has an electrically conductive rotor driven by the motor, a movable drag mechanism having a permanent magnet structure linked magnetically with the rotor for movement of the mechanism through electromagnetic interaction between the magnet structure and the rotor, a latching mechanism linked with the drag mechanism by means of another permanent magnet structure for restraining movement of the drag mechanism until the rotor attains a preset speed at which the latching mechanism releases the drag mechanism and allows limited movement thereof, a switch, and an actuator operatively linked with the drag mechanism and the switch for translating movement of the drag mechanism into switching of the switch.

7 Claims, 6 Drawing Figures

SPEED RESPONSIVE SWITCHING DEVICE

BACKGROUND OF THE INVENTION

This invention relates to a device responsive to the speed of a rotating member for carrying out a switching operation at a preset speed of the member. The nature of the device is such that a two-state switch in the device remains in one state until the member attains the preset speed and then switches rapidly to the other state. This second state can be retained until the device is deliberately re-set to the first state.

For many years it has been well known to fit large DC motors with an overspeed switching device. This has been done to protect the motor against the destructive effects of excessive speeds. Overspeed protection is considered necessary because certain combinations of field excitation and armature voltage and current can cause speeds in excess of the mechanical capabilities of the machine.

One of the better known prior art so-called "overspeed switching device" is a mechanical device, e.g., an assembly of weights, pivots, linkages and springs that rotates with the rotor of the motor. Rotation of the weights develops forces in the mechanism which increase in magnitude with increase in rotor RPM. The springs restrain movement of the weights until a preset speed is attained, upon which the weights move and actuate a switch. Operation of the switch then initiates an alarm or shuts the motor down.

Mechanical overspeed switching devices have many movable parts, and they are therefore subject to the problems of mechanical devices in general, e.g., the parts vibrate, wear, corrode, stick, etc., and the springs relax. Hence, they are not considered the most reliable safety devices, particularly for motors that may operate for long periods of time without the safety device being called upon to function. When called upon to rescue a motor from an overspeed situation, these mechanical devices may fail to do so in an effective manner, resulting in lessened overspeed protection for the motor, or even no protection.

SUMMARY OF THE INVENTION

An "overspeed switching mechanism" according to this invention consists essentially of an electrically conductive rotor member supported for rotation with the rotor of the motor; a drag mechanism supported for limited movement and having a first permanent magnet structure linked magnetically with the rotor member for movement of the mechanism through electromagnetic interaction between the magnet structure and the rotor member; a latching mechanism linked with the drag mechanism by means of a second permanent magnet structure for restraining movement of the drag mechanism until the rotor member attains a preset speed at which the latching mechanism releases the drag mechanism and allows limited movement thereof; switching means; and actuating means operatively linked with the drag mechanism and the switching means for translating movement of the drag mechanism into switching action of the switching means.

In the preferred embodiment, the rotor member is an electrically conductive disc, e.g., a copper or aluminum disc, mounted on the rotor shaft; the drag mechanism is a member supported for limited pivotal movement on an axis parallel to the axis of rotation of the disc and has a permanent magnet structure linked magnetically with the disc for pivotal movement of the member through electromagnetic interaction between the magnet structure and the disc during rotation thereof; and the latching mechanism in a combination of the following: a magnetic armature on the member in the configuration of a yoke having a number of teeth thereon projecting outwardly in a spaced semi circular array centered on the pivotal axis of the member, and a fixed permanent magnet field structure has two pole bodies of opposite magnetic polarity located directly opposite two teeth of the armature separated by at least one other tooth. In this latching combination, the armature and fixed permanent magnet field structure cooperate to provide a magnetic latch which restrains pivotal movement of the member at disc speeds below a preset speed and allows snap action pivotal movement of the member at disc speeds above the preset speed. An actuator, operatively linked with the member and an electric switch, translates member movement into switch operation. The resetting means may be a hand operated lever or knob.

To set the operating point of the drag mechanism for disc speed, i.e., the aforementioned preset speed, stronger permanent magnets than otherwise necessary are used in the fixed field structure, and a substantial portion of the magnetic flux is shunted around the pole bodies. Some of this flux is diverted by way of a shunt which is adjustable for purposes of setting the operating point of the drag mechanism to a particular disc speed. Preferably, the field structure will be adapted to receive another like shunt, which when applied is effective to cause operation of the drag mechanism at a preset lower disc speed. This second shunt may be applied periodically during the operating life of the motors for purposes of checking the operation of the overspeed mechanism.

Since changes in temperature alter the magnetic characteristics of permanent magnets, all the magnets used in the overspeed mechanism should be compensated for temperature for the most reliable performance of the mechanism. This can be done according to known techniques.

DESCRIPTION OF THE PREFERRED EMBODIMENTS

A preferred embodiment of the invention will now be described in more detail with reference to the accompanying drawings, in which.

Figure 1:
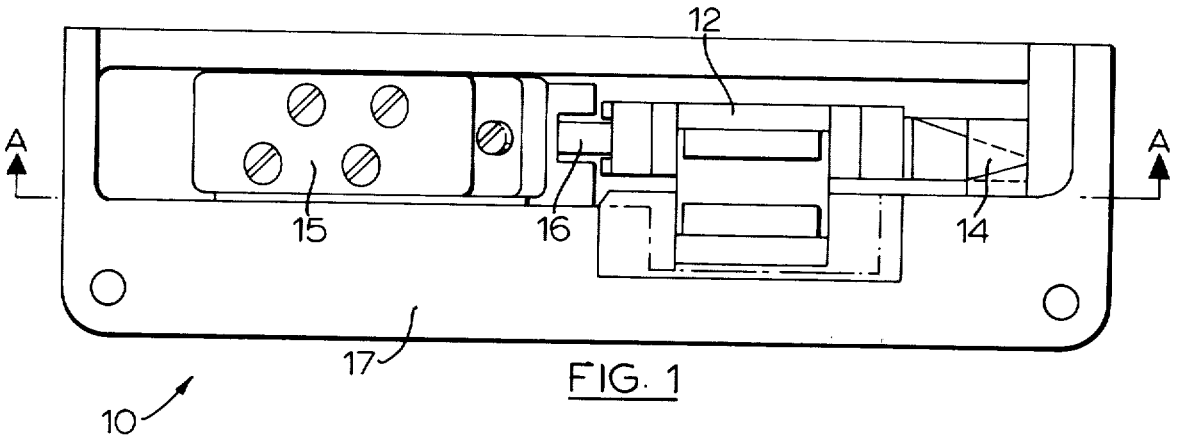
FIG. 1 is a view looking down on the overspeed switching mechanism.
Figure 2:
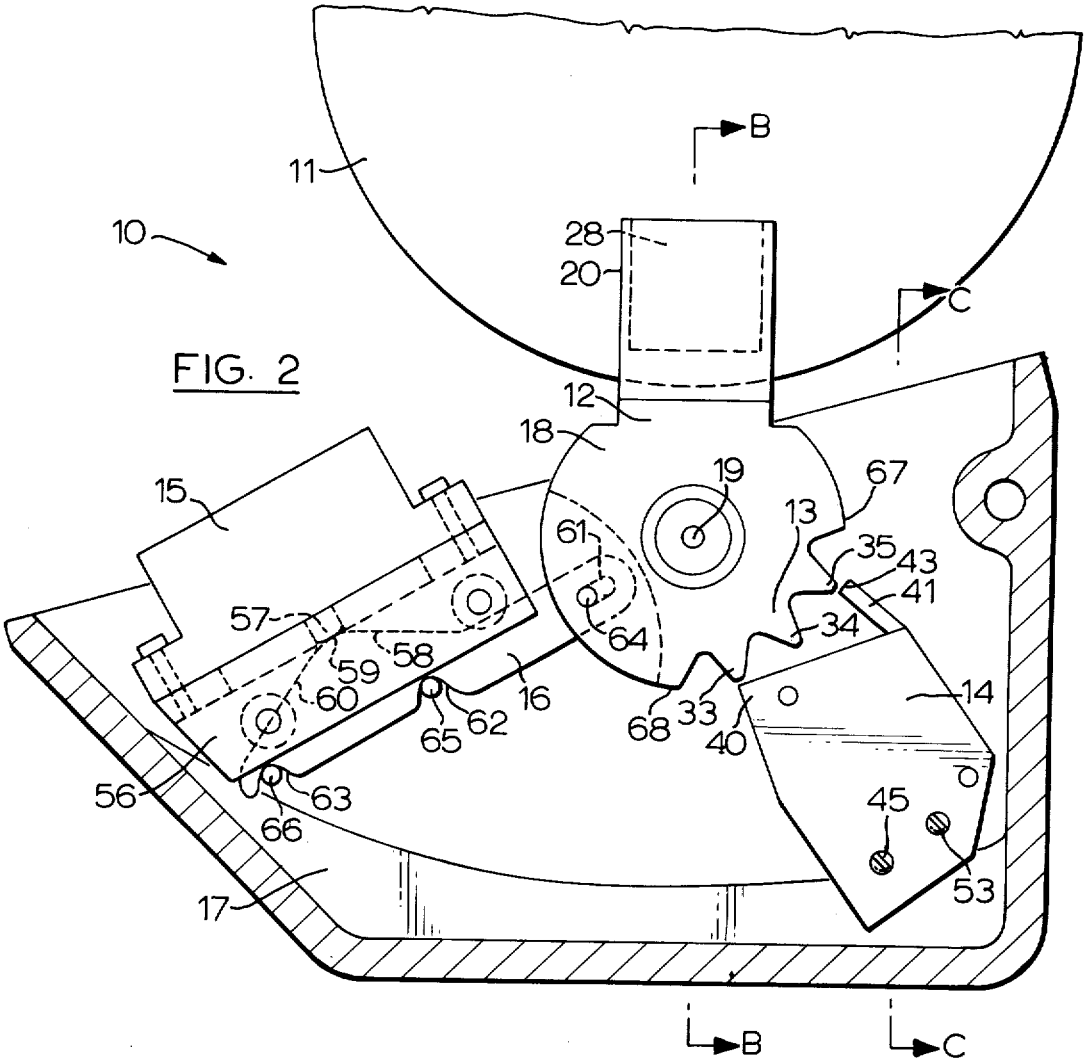
FIG. 2 is a view in cross section taken along A—A of FIG. 1.

In FIGS. 1 and 2, there is shown an overspeed switching mechanism 10 consisting essentially of the following major components; an electrically conductive disc 11; a movable permanent magnet drag mechanism 12; a latching mechanism composed of the combination of a magnetic armature 13 on the drag mechanism and a fixed permanent magnet field structure 14; an electric switch 15; and a switch actuator 16. Disc 11 is supported for rotation with the rotor of the motor, preferably directly on the rotor shaft. It is a rigid, flat, circular member made of a material which is a good electrical conductor, e.g., copper or aluminum, and it is thick enough to give it the required mechanical strength and current carrying capacity. The other components 12 to 16 of the switching mechanism are supported directly or indirectly on a frame structure 17, and the frame is supported for operatively relating the drag mechanism with the disc in a way to be described later.

Figure 3:
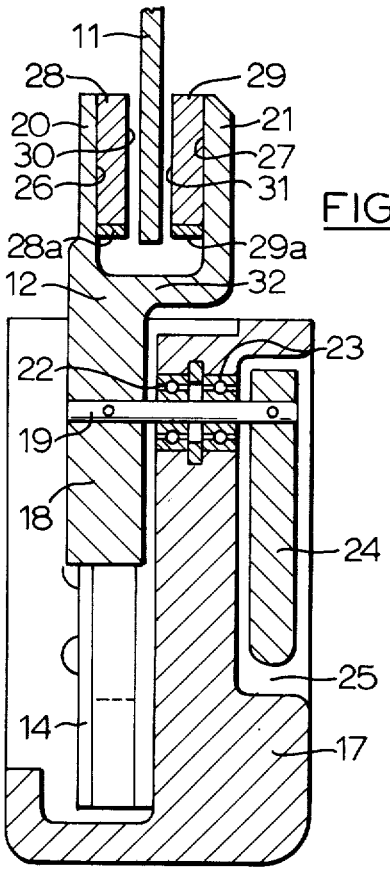
FIG. 3 is a view in cross section taken along B—B of FIG. 2.
Figure 4:
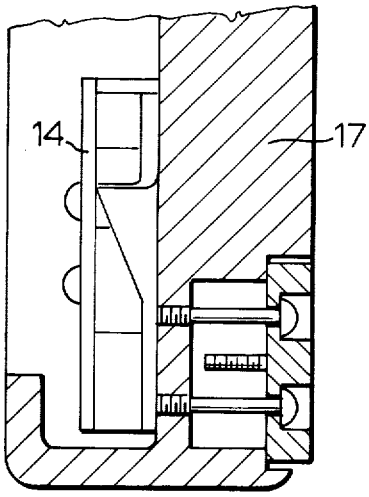
FIG. 4 is a view in cross section taken along C—C of FIG. 2.

Drag mechanism 12 is best illustrated in FIGS. 2 and 3. The mechanism has a flat, circular body portion 18 mounted on a pin 19 located in the middle of the body portion transverse thereto, and bifurcated portions 20 and 21 projecting radially from the body portion astride the peripheral surface of the disc and spaced therefrom. Pin 19 is secured to the body portion and in the inner races of ball bearing 22 and 23 which have their outer races secured in a bore hole in frame 17. The bearings and pin support the drag mechanism in spaced relation to the frame and allow it to rotate on an axis parallel to the axis of rotation of the disc. This rotation is limited to the angular movement needed for operation of the switching mechanism by the reset handle 24 located in the recess 25 in the frame and secured to the pin.

Members 20 and 21 have flat inner surfaces 26 and 27 parallel to the disc surfaces, and have flat permanent magnets 28 and 29 secured to these surfaces. These magnets have flat pole faces 30 and 31 of opposite magnetic polarity spaced slightly from and parallel to the disc surfaces. Permanent magnets well suited for use at 28 and 29 are those known as the cobalt-rare-earth magnets. In order to complete a magnetic circuit through the disc, portions 20 and 21 and that part 32 of body portion 18 interconnecting them must be made of a relatively good magnetic material such as a soft iron. Since the armature portion 13 must also be magnetic, the whole comprising portions 13, 18, 20 and 21 is best made in one piece from a good magnetic material such as a soft iron.

The permanent magnets selected for use at 28 and 29 have a magnetic capacity somewhat in excess of what is needed for the drag function in order that a significant portion of the flux can be made to bypass the circuit mentioned above for purposes of ambient temperature compensation. Ambient compensation is effected through the use of an iron-nickel shunt with each magnet, e.g., the shunts illustrated at **28*a* and 29*a* for magnets 28 and 29 respectively in FIG. 3**. The material of the shunts has a particular characteristic which is effective in causing the flux bypassing the circuit to be such in value that the flux in the circuit remains substantially constant regardless of temperature. This mode of compensation is known; further particular may be had from the following textbook:

Permanent Magnets and Their Applications R. J. Parker and R. J. Studders John Wiley and Son 1962 Pages 350 to 352

A mechanism for latching drag mechanism 12 has been identified by the combination of 13 and 14 and is illustrated in FIG. 2. Numeral 13 designates a magnetic armature on body portion 18 of the drag mechanism. This armature is in the form of three teeth 33, 34 and 35 which project radially from the body and terminate on the curvature of the periphery of the body at equally spaced intervals.

Figure 5:
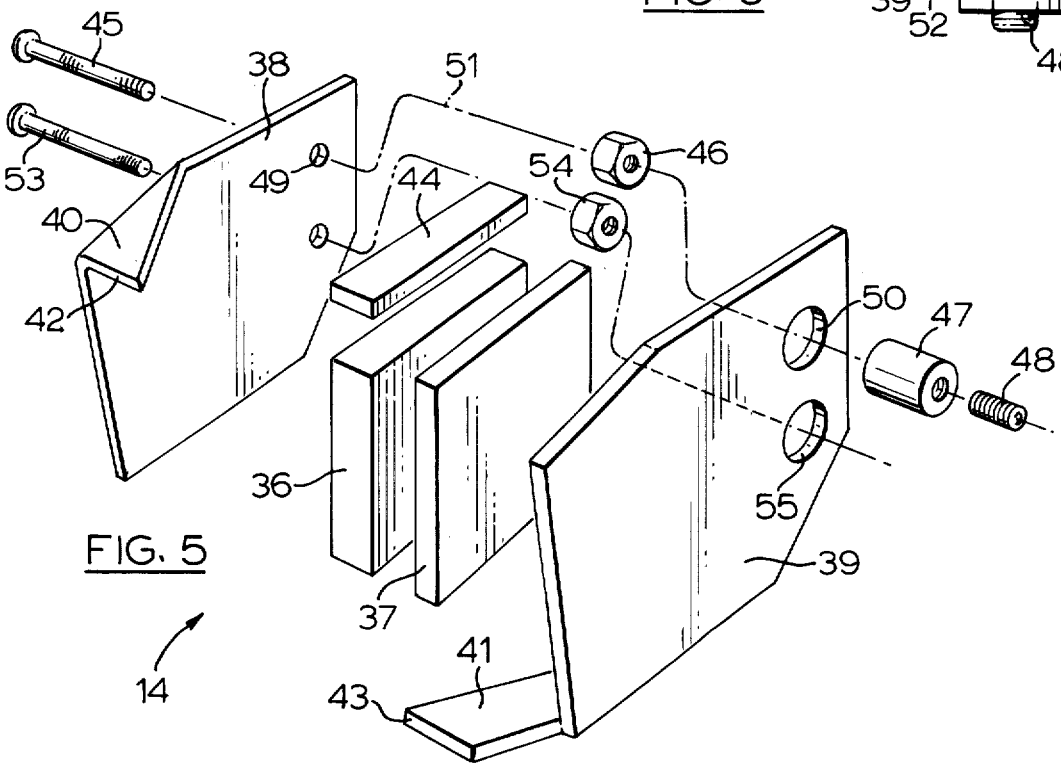
FIG. 5 is an exploded view in perspective of the magnet structure of the latching mechanism.

Reference should now be made to FIGS. 2 and 5 for an illustration of the permanent magnet field structure 14. This structure consists essentially of a permanent magnet 36, a magnetic spacer 37 and a pair of magnetic side plates 38 and 39 formed with pole structures 40 and 41 respectively. Items 36 to 39 are flat members of uniform thickness arranged in a sandwich-like assembly in which the members are secured together e.g., set in epoxy, and the assembly bolted to frame 17 with the faces 42 and 43 of pole structures 40 and 41 located opposite the extremities of teeth 33 and 35 of armature 13 and spaced a little therefrom. Elements 37 and 41 are made of a good magnetic material such as a low carbon steel, and element 36 may be a cobalt-rare-earth permanent magnet.

The main magnetic circuit for permanent magnet 36 is as follows: spacer 37, plate 39, pole structure 41, tooth 35, the yoke of armature 13, tooth 33, pole structure 40, plate 38, and the two gaps between the pole structures and the teeth. The permanent magnet selected for use at 36 has a magnetic output in excess of that necessary for the latching function. This allows a substantial portion of the magnetic flux to bypass the circuit mentioned above, and be shunted across the magnet for purposes of ambient temperature compensation and calibration of the latching mechanism. Ambient compensation is accomplished by the known technique described in connection with magnets 28 and 29, e.g., by means of the shunt illustrated at 44 in FIG. 5.

Figure 6:
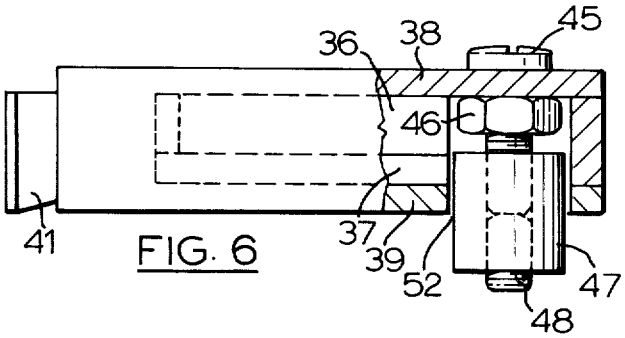
FIG. 6 is a view of the magnet structure of the latching mechanism showing a magnetic shunt.

Reference should now be made to FIGS. 5 and 6. The means employed for calibrating the switching mechanism, i.e., setting the point at which switch 15 changes state for a particular motor speed, will now be described. In essence, this is done by providing a permanent magnet 36 with a flux output greater than necessary for the latching function, and also providing an adjustable shunt for diverting some of the flux away from the pole structures and armature. e.g., 7 to 8% of the total flux. An adjustable shunt of this nature is illustrated as consisting of a non magnetic bolt 45, a non magnetic nut 46, a magnetic flux shunting member 47 and a setscrew 48. Plates 38 and 39 contain holes 49 and 50 respectively having their centers on an axis 51 transverse to the plates. Hole 49 receives bolt 45, and nut 46 secures the bolt to plate 38 with its threaded end projecting along axis 51 toward hole 50. Member 47 is cylindrical in shape and contains an axial bore threaded to be received onto the bolt. Hole 50 is somewhat larger in diameter than the diameter of member 47. Therefore, when member 47 is threaded onto bolt 45, an annular gap 52 remains between plate 39 and the peripheral surface of the member. The shunting member is made from a relatively good magnetic material such as a low carbon steel. It will be noted from FIG. 6 that the farther member 47 is threaded onto bolt 45, the better the flux path it provides from magnet 36 to plate 39 via gap 52. Hence, the amount of flux bypassing pole structures 40 and 41 depends on the position of the shunting member, a position that is adjustable along the bolt. Screw 48 is provided for locking the shunting member to the bolt when calibration is completed.

The latching mechanism is readily adapted for checking of its calibration at the time of installation of the motor and periodic checking during the operation life of the motor. This is carried out at a speed well within the normal operating speed of the motor, e.g., at a speed 15 to 25% below the speed that mechanism 10 protects the motor from exceeding. Another flux shunting structure like that described in the foregoing paragraph is provided for checking purposes. To this end, plate 38 has a non magnetic bolt 53 secured to it by means of a non magnetic nut 54 so that the threaded end of the bolt projects toward and on the axis of the hole 55 in plate 39. This hole is adapted to receive a shunting member in the way that hole 50 receives member 47. This second shunting member is supplied with the machine, but it is not assembled to the permanent magnet structure 14. It is used for checking purposes only by threading it onto the bolt, and once checking has been completed it is removed and stored away until needed again.

Referring again to FIG. 2, an actuator 16 operatively connects drag mechanism 12 to switch 15. Switch 15 is mounted on a bracket 56 and the bracket is mounted on frame 17. The switch has an actuator 57 which is spring biased against a cam surface on the actuator identified by numerals 58, 59 and 60, surfaces 58 and 60 being alike except they slope in opposite directions from a mid high point 59. Actuator 16 is a flat, elongated member having the cam surfaces along one edge face near one end of the member. The member has a slot 61 through its flat sides at its other end, and a pair of notches 62 and 63 in its other edge face opposite the cam surfaces. The actuator is supported with one flat surface spaced from and substantially parallel to an adjacent flat surface on frame 17 by means of a slot in bracket 56, a slot in body portion 18 of drag mechanism 12 and three pins 64, 65 and 66, the slots being substantially parallel to the flat frame surface and the pins transverse thereto. The slotted end of the actuator fits loosely into the slot in body portion 18 and is retained therein by means of pin 61 passing through the slot in the actuator and secured in the body portion. Hence, this end of the actuator must move with rotary movement of the body portion 18. That flat portion of the actuator providing the cam surfaces fits loosely into the slot in bracket 56, and pins 65 and 66 retain it in this slot with the cam surfaces pressed against switch actuator 57. Pins 65 and 66 are secured in frame 17 and located in actuator notches 62 and 63 respectively, and actuator 57 biases actuator 16 against these pins by way of its spring. The spacing between pins 65 and 66 is such that rotation of drag mechanism 12 in either directions causes switch operation, i.e., causes the switch to change the state of its contacts from open to closed or vice versa. In FIG. 2 the switch is shown with its actuator 57 bearing on cam surface 59, and pole structures 40 and 41 of the permanent magnet field structure 14 at teeth 33 and 35 respectively of armature 13. This is the neutral state for mechanism 10, and, of course, the normal state for the switch contacts. Rotation of drag mechanism 12 clockwise causes actuator 16 to pivot counter clockwise on pin 66. This causes actuator 57 to ride on cam surface 58 and be depressed to operate the switch. Rotation of the drag mechanism counter clockwise causes the actuator to pivot clockwise on pin 65, and this then causes actuator 57 to ride on cam surface 60 and be depressed to operate the switch. Hence it can be seen that the overspeed switching mechanism is insensitive to the direction of rotation of the disc; it is equally effective as a protective device for either direction of rotation.

The operation of the overspeed switching mechanism will now be discussed as best seen from FIGS. 2 and 3, magnets 28 and 29 are disposed in flux aiding relation in the magnetic circuit comprised of the following magnetic members: magnet 28, disc 11, magnet 29, magnetic portions 21, 32 and 20, and the air gaps between the disc and the pole faces of the magnets. Since this circuit includes the disc, rotation thereof induces eddy currents in the disc, eddy currents which urge the permanent magnet field structure to follow rotation of the disc. Stated otherwise, clockwise rotation of the disc urges counter clockwise rotation of drag mechanism 12 about its pivotal axis 19, and vice versa. This urge or "drag force" increases linearly with disc speed.

The latching mechanism comprised of the permanent magnet field structure 13 and the armature 13 on drag mechanism 12 restrains pivotal movement of the drag mechanism through magnetic interaction between pole structures 40, 41 and teeth 33, 35 respectively during normal disc speeds. This tendency for the teeth to hang onto the pole structures is at an essentially constant value of force, which exceeds the drag force for normal disc speeds. However, at a preset overspeed of the disc the constant value restraining force of the latching mechanism is exceeded by the drag force, at which point the latching mechanism lets go of the drag mechanism and allows it to rotate one tooth pitch with a snap action, further rotation being stopped by the reset handle 24 abutting stops in recess 25 on frame 17. Rotation of the drag mechanism then causes pivotal movement of actuator 16 resulting in operation of switch 15 to initiate an alarm or down of the motor. To be more specific, an excessive speed of disc 11 clockwise force rotation of drag mechanism 12 counter clockwise to place tooth 34 opposite pole structure 41 and peripheral surface 68 of body portion 18 opposite pole structure 40. Counter clockwise rotation of mechanism 12 then forces pivotal movement of actuator 16 on pin 65 and thereby driving cam surface 60 against actuator 57 far enough to operate switch 15. An excessive speed of disc 11 counter clockwise forces rotation of mechanism 12 clockwise to place tooth 34 opposite pole structure 40 and peripheral surface 67 of body portion 18 opposite pole structure 41. Clockwise rotation of mechanism 12 then forces pivotal movement of actuator 16 on pin 66 and thereby driving cam surface 58 against actuator 57 far enough to operate switch 15. The drag mechanism is reset by manually turning handle 24 to the neutral position of its armature 13 with respect to pole structures 40 and 41.

Calibration of the overspeed switching mechanism will now be described with reference to FIGS. 5 and 6. It has already been pointed out that permanent magnet 36 has a magnetic capacity well in excess of that needed for the latching function. Calibration is carried out as follows:

1. The overspeed mechanism is mounted in a test rig, and the disc driven at the speed that the motor is not to exceed.

2. Shunting member 47 is screwed onto bolt 45 at a slow rate until it reaches a point at which the mechanism operates. This point can be readily detected by connecting the switch to a light and a power source and observing the light, i.e., the point at which the light turns on.

3. The test is repeated for the other direction of disc rotation.

4. Finally, shunt member 47 is locked onto bolt 45 by means of setscrew 48. The setting of the shunt member may now be re-checked to ensure it has not been disturbed during setscrew locking. The procedure for setting the mechanism so that it can be checked while on the motor may be carried out as follows:

1. with the mechanism still in the test rig, the disc is driven at a speed well below the calibrated overspeed, i.e., well within the normal operating speed of the motor.

2. A shunting member like number 47 is screwed onto bolt 53 at a slow rate until it reaches a point at which the mechanism operates. This point is clearly identified, e.g., by means of a stop on bolt 53, so the application of the shunt can be repeated with the same results.
3. The test is repeated for the other direction of disc rotation.
4. Finally, this shunt is removed from the bolt and stowed away with the mechanism.

Since the mechanism operates equally well for either direction of rotation of the disc, there is no need to know the direction of rotation of the motor to which it is to be fitted. Moreover, the flux shunting features are sufficiently versatile that the mechanism can be calibrated for a number of different speeds. This, along with direction of rotation insensitivity, are very decided advantages; one type of mechanism can be used with a number of different motors. A switching mechanism can be adapted for different trip speed categories by using different conductive discs, i.e., copper for lower speeds, aluminum for higher speeds, or variations in disc thickness.

The embodiments of the invention in which an exclusive property or privilege is claimed are defined as follows:

1. An overspeed switching mechanism for a motor comprising an electrically conductive rotor member supported for rotation with the rotor of the motor; a drag mechanism supported for limited movement and having a first permanent magnet structure linked magnetically with said rotor member for movement of the drag mechanism through electromagnetic interaction between the magnet structure and the rotor member during rotation thereof; a latching mechanism linked with said drag mechanism by means of a second permanent magnet structure for restraining movement of the drag mechanism until said rotor member attains a preset speed at which the latching mechanism releases the drag mechanism and allows limited movement thereof with a snap action; switching means; actuating means operatively linked with said drag mechanism and said switching means for translating movement of the drag mechanism into switching action of the switching means; and means for resetting said drag mechanism.

2. An overspeed switching mechanism for a motor comprising an electrically conductive disc supported for rotation with the rotor of the motor; a drag mechanism supported for limited pivotal movement of the axis parallel to the axis of rotation of said disc and having a permanent magnet structure linked magnetically with the disc for pivotal movement of the drag mechanism through electromagnetic interaction between the magnet structure and the disc during rotation thereof; a latching mechanism of the following combination: a magnetic armature on said drag mechanism in the configuration of a yoke having a number of teeth thereon projecting outwardly in a spaced semi circular array centered on said pivotal axis, and a fixed permanent magnet field structure having two pole bodies of opposite magnetic polarity located directly opposite two teeth of the armature separated by at least one other tooth, said armature and fixed permanent magnet field structure cooperating to provide a magnetic latch which restrains pivotal movement of the drag mechanism at disc speeds below a preset speed and allows snap action pivotal movement of the drag mechanism at disc speeds above the preset speed; switching means; actuating means operatively linked with said drag mechanism and said switching means for translating pivotal movement of the drag mechanism into switching action of the switching means; and means for resetting said drag mechanism.

3. An overspeed switching mechanism according to claim 2 wherein said fixed permanent magnet field structure includes a magnetic shunt adjustable for shunting a certain amount of magnetic flux around said armature for purposes of setting the point at which the latching mechanism releases the drag mechanism for a given value of said preset disc speed.

4. An overspeed switching mechanism according to claim 3 wherein said fixed permanent magnet field structure includes means for temporarily receiving another shunt for shunting an additional amount of magnetic flux around said armature for purposes of checking the point at which the latching mechanism releases the drag mechanism for a disc speed lower than said given value of preset speed.

5. An overspeed switching mechanism according to claim 2 wherein said means for resetting the drag mechanism is a manually operated means.

6. An overspeed switching mechanism according to claim 2 wherein said permanent magnet structures include ambient temperature compensating magnetic material.

7. An overspeed switching mechanism according to claim 2 wherein said actuating means comprises means for translating movement of the drag mechanism in either direction into switching action of the switching means, and thereby rendering the overspeed mechanism non sensitive to the direction of rotation of the rotor of the motor.

* * * * *